US005642585A

United States Patent [19]

Watley

[11] Patent Number: 5,642,585

[45] Date of Patent: Jul. 1, 1997

[54] SCOPE PROTECTOR FOR MUZZLELOADING RIFLES

[75] Inventor: Lindell Dale Watley, Centerville, Iowa

[73] Assignee: Modern Muzzleloading, Inc., Centerville, Iowa

[21] Appl. No.: 549,085

[22] Filed: Oct. 27, 1995

[51] Int. Cl.[6] ..... F41A 35/04; F41G 11/00; B65D 65/06

[52] U.S. Cl. ..... 42/96; 33/244; 150/154

[58] Field of Search ..... 42/96; 33/244; 150/154; 206/317

[56] References Cited

U.S. PATENT DOCUMENTS

| | | | |
|---|---|---|---|
| 2,599,689 | 6/1952 | Brelsford | 42/96 |
| 4,398,367 | 8/1983 | Gamble et al. | 42/96 |
| 4,860,479 | 8/1989 | Easter | 42/96 |
| 5,048,217 | 9/1991 | Easter | 42/96 |
| 5,183,953 | 2/1993 | Anderson et al. | 42/96 |

*Primary Examiner*—Michael J. Carone
*Assistant Examiner*—Theresa M. Wesson
*Attorney, Agent, or Firm*—Zarley, McKee, Thomte, Voorhees, & Sease

[57] ABSTRACT

A scope protector has an elongated strip of a flexible sheet material having a center portion, inner and outer side surfaces, and opposite ends. A first fastening element is on the outer surface of one end of said strip, and a second fastening element is on the inner surface at the other end of said strip. The length of the strip is slightly greater than the circumference of the scope uponwhich it is to be mounted so that the fastening elements can be superimposed on each other when the strip is wrapped around the scope.

18 Claims, 1 Drawing Sheet

SCOPE PROTECTOR FOR MUZZLELOADING RIFLES

BACKGROUND OF THE INVENTION

Muzzleloading rifles of current times often are equipped with conventional scopes to increase the accuracy of the rifle. The scopes are typically mounted in spaced relation directly over the breech of the rifle. As the rifle is fired and the breech is opened, the bottom side of the mounted scope is deposited with residue from the black powder used in firing the rifle. This residue contains elements which are very detrimental to the structure of the scope. This residue typically reduces the useful life of the scope.

Some hunters have wrapped electrical tape around the scope, but that is time consuming both to install and remove. The tape can also leave an unwanted residue on the scope. Other attempts have been made to place detachable shields on the scope, but these have been unable to be easily adapted to the shape of the scope, including the scope adjustment knob.

It is therefore the principal object of this invention to provide a scope protector for muzzleloading rifles which can be easily installed on and removed from the scope.

A further object of this invention is to provide a scope protector for muzzleloading rifles which can be easily conformed to the shape of the scope.

A still further object of the invention is to provide a scope protector for muzzleloading rifles which can protect both the body of the scope and the scope adjusting knob.

A still further object of the invention is to provide a scope protector for muzzleloading rifles which can protect the fastening elements thereon from the residue blown from the rifle breech when the rifle is fired.

These and other objects will be apparent to those skilled in the art.

SUMMARY OF THE INVENTION

The scope protector of this invention is intended for use on muzzleloading rifles which have an elongated scope with a center portion located in spaced relationship over an openable breech in the rifle. The scope protector has at least one elongated strip of flexible sheet material having a center portion, inner and outer side surfaces, and opposite ends. A first fastening element is located on the outer surface at one end of the strip and a second fastening element is located on the inner surface at the other end of the strip. The length of the strip is slightly greater than the circumference of the center portion of the scope so that the fastening elements can be superimposed on each other in mating relationship to hold the strip on the scope when the strip is wrapped around the center portion of the scope.

DESCRIPTION OF THE PREFERRED EMBODIMENT

Figure 1:
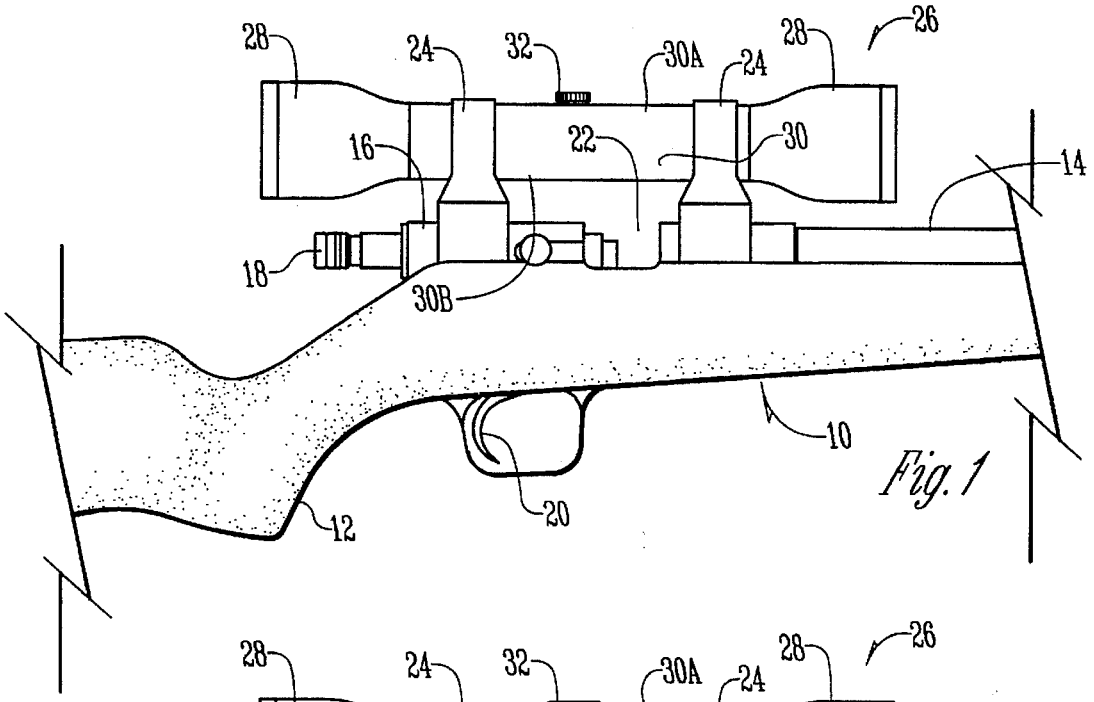
FIG. 1 is a partial side elevational view of a muzzleloading rifle with a scope mounted thereon.

A conventional muzzleloading rifle 10 has a stock 12, a barrel 14, a receiver 16, a bolt and hammer assembly 18, a trigger assembly 20 and a breech opening 22 which becomes open when the rifle is fired. Residue from the black powder used in the firing process typically leaves the breech opening 22 and moves in an upwardly direction.

Conventional scope brackets 24 are mounted to the receiver 16 and the barrel 14. A conventional rifle scope 26 is mounted in brackets 24. Scope 26 has enlarged ends 28 and a cylindrical center portion 30 of reduced diameter. The center portion 30 has a top 30A and a bottom 30B. A conventional scope adjustment knob 32 is typically mounted in the top center of center portion 30.

Figure 2:
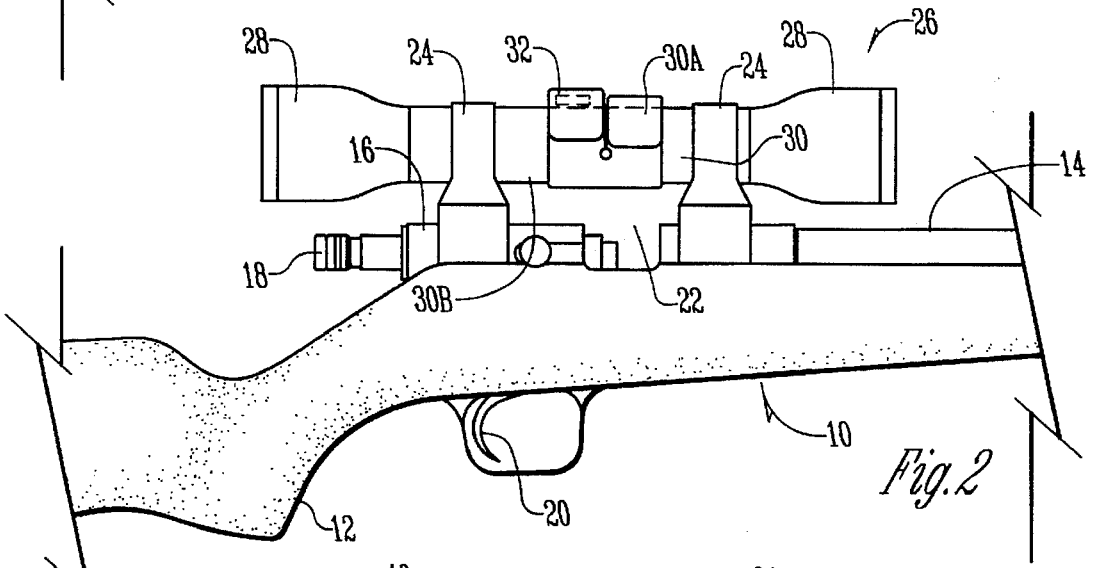
FIG. 2 is a partial side elevational view of a muzzleloading rifle with a scope mounted thereon and with the scope protector of the invention mounted on the center of the scope.
Figure 3:
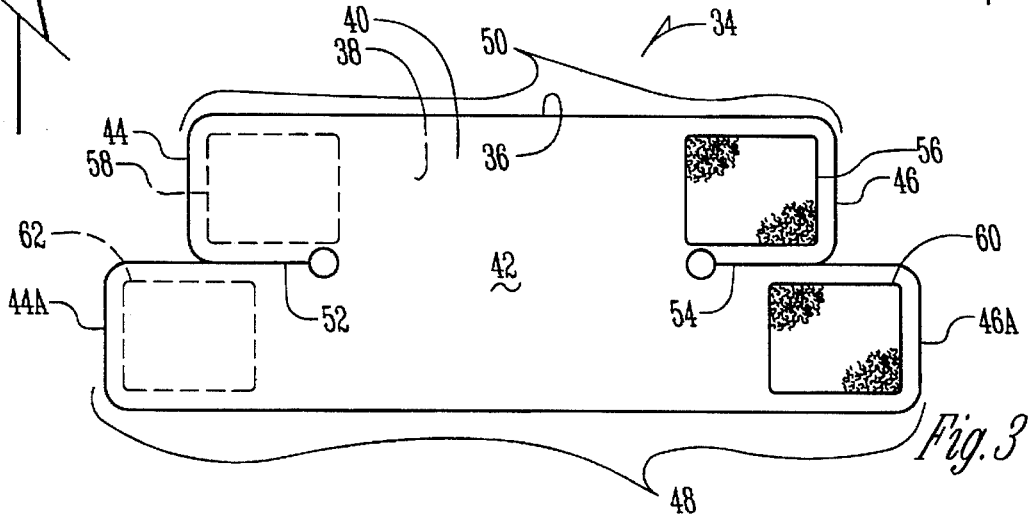
FIG. 3 is a plan view of the scope protector of this invention

A scope protector 34 is comprised of a sheet member 36 which is of any suitable flexible material, such as plastic, which will not adhere to the material of the scope 26. Sheet member 36 has an inner side surface 38 and an outer side surface 40. The sheet member 36 also has a center portion 42 and ends 44 and 44A, and opposite ends 46 and 46A. (FIG. 2). The sheet member is divided into separate strips 48 and 50 with strip 48 being slightly longer than strip 50. The strips are defined primarily by separate slits 52 and 54 which partially bisect the sheet member 36. A Velcro® hook pad 56 is glued or otherwise secured to the outer surface of strip 50 at end 46. A second mating Velcro® loop pad 58 is located on the opposite side surface 38 adjacent end 44. Similarly, hook pad 60 is affixed to outer surface 40 adjacent end 40A. A mating loop pad 62 is mounted on strip 50 on the opposite inner side surface 38 adjacent end 44A.

The length of strip 50 is slightly greater than the circumference of the cylindrical portion 30 of scope 26 so that the pads 56 and 58 will come into mating engagement when the strip 50 is wrapped around the center portion 30.

Similarly, the length of strip 48 when wrapped around center portion 30 of scope 26 is sufficient so that the pads 60 and 62 come into mating relationship on top of the scope adjustment knob 32.

It should be noted that all of the hook and loop pads are located adjacent the top 30A of center portion 30 so that they will not be in the direct path of residue being blown out of breech opening 22.

The slits 52 and 54 facilitate the wrapping of the strips 50 and 52 into circular configurations of different diameters.

It can be seen that the scope protector 34 can be easily wrapped around the center portion 30 of the scope 26 and can be easily fastened in position thereon through the use of the pads 56, 58, 60 and 62. The combined width of the two strips 50 and 52 is greater than the length of the breech opening 22 so that the bottom 30B of the center portion 30 of the scope is adequately protected from residue being blown from the breech opening 22. The pads, by being on top of the scope, are less susceptible to deterioration from the blast of the residue material.

The scope protector can be easily removed by reversing the above described process of installation. The scope protector serves to adequately protect the material of the scope from the deteriorating effects of the residue blown from the breech opening 22.

It is therefore seen that this invention will achieve at least its stated objectives.

What is claimed is:

1. A scope protector for muzzleloading rifles which have an elongated scope with a center portion located in spaced relation over an openable breech on the rifle, comprising, an elongated strip of flexible sheet material having a center portion, inner and outer side surfaces, and opposite ends, a first fastening element on the outer surface at one end of said strip, a second fastening element on the inner surface at the other end of said strip, the length of said strip being slightly greater than the circumference of the center portion of said scope so that said fastening elements can be superimposed on each other in mating relationship to hold said strip on said scope when said strip is wrapped around the center portion of said scope whereupon the entire length of said strip extends completely around the shape of the center portion of said scope in spaced relation to said openable breech so that said scope will be protected from residue moving upwardly from said breech when said rifle is fired.

2. The device of claim 1 wherein said scope protector is secured on a rifle mounted scope in the manner described, and said fastening elements are located on the top of said scope and shielded by the lower center portion said scope from the residue blown from said breech when the rifle is fired.

3. The device of claim 1 wherein the inner and outer surfaces of said sheet material are of a composition that will not adhere to the scope.

4. The device of claim 1 wherein said fastening elements are hook and loop-type fastening elements.

5. The device of claim 1 wherein the width of said openable breach is less than the width of said strip.

6. The device of claim 1 wherein the width of said openable breach is less than the width of said strip.

7. A scope protector for muzzleloading rifles which have an elongated scope with a center portion located in spaced relation over an openable breech on the rifle, comprising, an elongated strip of flexible sheet material having a center portion, inner and outer side surfaces, and opposite ends, a first fastening element on the outer surface at one end of said strip, a second fastening element on the inner surface at the other end of said strip, the length of said strip being slightly greater than the circumference of the center portion of said scope so that said fastening elements can be superimposed on each other in mating relationship to hold said strip on said scope when said strip is wrapped around the center portion of said scope, said scope protector being secured to said scope mounted on one of said rifles, said fastening elements being located on the top of said scope and shielded by the lower center portion of said scope from the residue blown from said breech when the rifle is fired.

8. The device of claim 7 wherein the inner and outer surfaces of said sheet material are of a composition that will not adhere to the scope.

9. The device of claim 1 wherein said strip comprises a first strip and has a second elongated strip secured thereto, said strips being positioned in parallel positions and being substantially identical except for said second strip being longer than said first strip to permit said second strip to encompass the center portion of said scope, and a control knob on the top of said scope.

10. The device of claim 9 wherein said scope protector is secured on to a rifle mounted scope in the manner described, and said fastening elements are located on the top of said scope and shielded by the lower center portion said scope from the residue blown from said breech when the rifle is fired, said second elongated strip extending over a control knob on the top of said scope.

11. The device of claim 9 wherein said first and second strips comprise a single sheet of material, said strips being joined along a center portion of an adjacent edge, and separated by slits extending outwardly in a horizontal direction from the center section of said adjacent edge.

12. The device of claim 7 wherein the inner and outer surfaces of said sheet material are of a composition that will not adhere to the scope.

13. The device of claim 7 wherein said strip comprises a first strip and has a second elongated strip secured thereto, said strips being positioned in parallel positions and being substantially identical except for said second strip being longer than said first strip to permit said second strip to encompass the center portion of said scope, and a control knob on the top of said scope.

14. The device of claim 13 wherein said scope protector is secured on to a rifle mounted scope in the manner described, and said fastening elements are located on the top of said scope and shielded by the lower center portion of said scope from the residue blown from said breech when the rifle is fired, said second elongated strip extending over a control knob on the top of said scope.

15. The device of claim 13 wherein said first and second strips comprise a single sheet of material, said strips being joined along a center portion of an adjacent edge, and separated by slits extending outwardly in a horizontal direction from the center section of said adjacent edge.

16. The device of claim 7 wherein said fastening elements are hook and loop-type fastening elements.

17. The device of claim 7 wherein the width of said openable breech is less than the width of said strip.

18. The device of claim 7 wherein the width of said openable breech is less than the width of said strips.

* * * * *